United States Patent [19]
Faller, Sr. et al.
[11] Patent Number: 4,907,647
[45] Date of Patent: Mar. 13, 1990

[54] HEAT EXCHANGER

[76] Inventors: Alexander Faller, Sr.; Alexander Faller, Jr., both of Rottenburger Strasse 14, Ergoldsbach, Fed. Rep. of Germany, 8305

[21] Appl. No.: 220,372

[22] Filed: Jul. 11, 1988

Related U.S. Application Data

[63] Continuation of Ser. No. 939,127, filed as PCT EP86/00143 on Mar. 14, 1986, published as W086/05579 on Sept. 25, 1986, abandoned.

[30] Foreign Application Priority Data

Mar. 14, 1985 [DE] Fed. Rep. of Germany ... 3,509,226

[51] Int. Cl.[4] ..... F28D 7/02
[52] U.S. Cl. ..... 165/164; 165/170
[58] Field of Search ..... 165/164, 165, 170

[56] References Cited

U.S. PATENT DOCUMENTS

| | | | |
|---|---|---|---|
| 2,131,265 | 9/1938 | Buchawsky | 165/164 |
| 2,217,316 | 10/1940 | Kallsteruis | 165/164 |
| 2,736,533 | 2/1956 | Allen | 165/140 |
| 3,921,713 | 11/1975 | Schnitzer et al. | 165/167 |
| 4,577,683 | 3/1986 | Kelch | 165/164 |

FOREIGN PATENT DOCUMENTS

| | | | |
|---|---|---|---|
| 128288 | 2/1901 | Fed. Rep. of Germany | 165/164 |
| 594278 | 7/1931 | Fed. Rep. of Germany | 165/164 |
| 666910 | 2/1937 | Fed. Rep. of Germany | 165/164 |
| 676642 | 3/1939 | Fed. Rep. of Germany | 165/164 |
| 1913226 | 3/1969 | Fed. Rep. of Germany | 165/164 |
| 1908385 | 6/1970 | Fed. Rep. of Germany | 165/164 |
| 775415 | 12/1934 | France | 165/164 |
| 2186636 | 1/1974 | France | 165/164 |
| 2132330 | 7/1984 | United Kingdom | 165/164 |

*Primary Examiner*—Ira S. Lazarus
*Assistant Examiner*—Peggy A. Neils
*Attorney, Agent, or Firm*—Cohen, Pontani & Lieberman

[57] ABSTRACT

Heat exchanger with two into each other running spiral channels (12, 14) for the flow of a heat yielding and of a heat absorbing medium, with two plates (10, 10') closing frontally the channels (12, 14) as well as with an inlet aperture (32) and with an outlet aperture (34) for each of the two channels (12, 14), whereat for the construction of a compact and easily dismantable unit and for a sure seal of the channels (12, 14) the spiral wall surfaces limiting the channels (12, 14) radially to the outside and to the inside have a straight generatrix and whereat the axial ends of the channel walls (16) are pressed against an elastically flesible seal side which is provided at the respectively opposing plate (10, 10').

1 Claim, 5 Drawing Sheets

HEAT EXCHANGER

This is a continuation of U.S. application Ser. No. 939,127, filed as PCT EP86/00143 on Mar. 14, 1986, published as WO86/05579 on Sep. 25, 1986 now abandoned.

The invention concerns a heat exchanger with two into each other running spiral channels for the flow of a heat yielding and of a heat absorbing medium, with two plates closing frontally the channels as well as with an inlet and an outlet aperture for every channel.

Such heat exchanger is described and illustrated in the DE-GM 66 05 139. The channel walls consist there of two sheet strips, namely a so called exterior belt and a so called interior belt. At one axial end the exterior belt is bent to the interior belt and welded to the same, so that the channel is hermetically closed at this front side. The other channel in corresponding manner is hermetically closed at the other front side by the weldment of the two sheet strips. Consequently to this construction the cleaning of the heat exchanger is rendered more difficult for on the one hand every channel is accessible only from one side after having taken off the referring plate, and on the other hand dirt may deposit at the weldment joint opposite to the open front side of the channel. Such dirt deposits can be removed only very hardly or not at all. Disadvantageous is furthermore the manufacture of this heat exchanger which needs a lot of bending and welding work.

The object of DE-PS 128 288 is a liquid cooling appliance of square base, the channels of which for the flow of the liquid to be cooled, beer for example, are spirally formed and rectangularly turned at the square corners. The channels are constituted by two plates provided with spiral, in the cross section semicircular impressions and by a plain intermediate plate. This heat exchanger is to be set into a cooling container for cooling the liquid.

In the case of a further heat exchanger which has been explained in the DE-PS 19 13 226, there between two end plates hollow disks with spiral channels are arranged. These disks consist of each two plates which have been joint together by weldment or by similar method. Consequently these channels can be cleaned only with certain restrictions.

The function of this invention is the design of a heat exchanger of the type as mentioned in the beginning of this paper of such simple construction that it cannot only be manufactured priceworthy, but also above all easily dismatled in order to clean it thoroughly on demand. In spite of the possibility of simply and quick dismantling, the correct sealing of the channels should not be impaired.

The invention solves this problem at a heat exchanger of the mentioned type thereby that the spiral wall surfaces limiting the channels radially to the outside and to the inside have a straight generatrix, and that the axial ends of the channel walls are pressed against an elastically flexible seal side which is provided at the respectively opposite plate.

In the case of such heat exchanger the channel walls can be bent spirally from a simple sheet strip without being forced to join them together at their axial ends by welding or by a similar method in order to close the channels to the outside. The function of the channel closing and of the reciprocal sealing of the channels undertakes here the elastically flexible seal side, into which the axial ends of the channel walls are pressed. An essential advantage is the possibility of thoroughly cleaning the channels after having taken off the two plates since no corners and edges or junction points impair the comfortable accessibility. This is particularly important at the use of the heat exchanger in the food industry with its strict requirements to hygienics, for example in breweries, distilleries and similars.

According to a further characteristic feature of this invention the channel walls of both channels are composed of only one coherent sheet strip which to the center is spirally bent in order to pass over there to the second spiral conducted to the outside.

It is particularly advantageous when the sealing surface consists of a sealing disk which is fastened to the respective plate, whereat a pressure medium (air or liquid) can be introduced between the same and the plate. These measures improve the correct sealing of the channels and avoid leakage losses, above all important when the plates consequently to the interior pressure of the heat exchanger are bent outwards. Plastics or rubber, for example, are suited as materials for the sealing disks.

The channel walls and the plates can be kept together by means of clamp fittings in order to make it easier not only to assemble them but above all to dismantle them for cleaning purposes.

The invention provides furthermore that a front plate of the heat exchanger the same time covers a second heat exchanger of the same type which axially in series is connected to the first one, whereat in the central range of this intermediate plate a passage aperture is incorporated for the heat absorbing medium and a passage aperture for the counterflowing heat yielding medium.

Such twin heat exchanger with counter flow service is of an excellent efficiency and due to its compact construction style and its low exterior surface of only low heat losses.

Further characteristics and advantages of the invention result from the subclaims and from the following description of a constructional example illustrated in the drawing.

Figure 1:
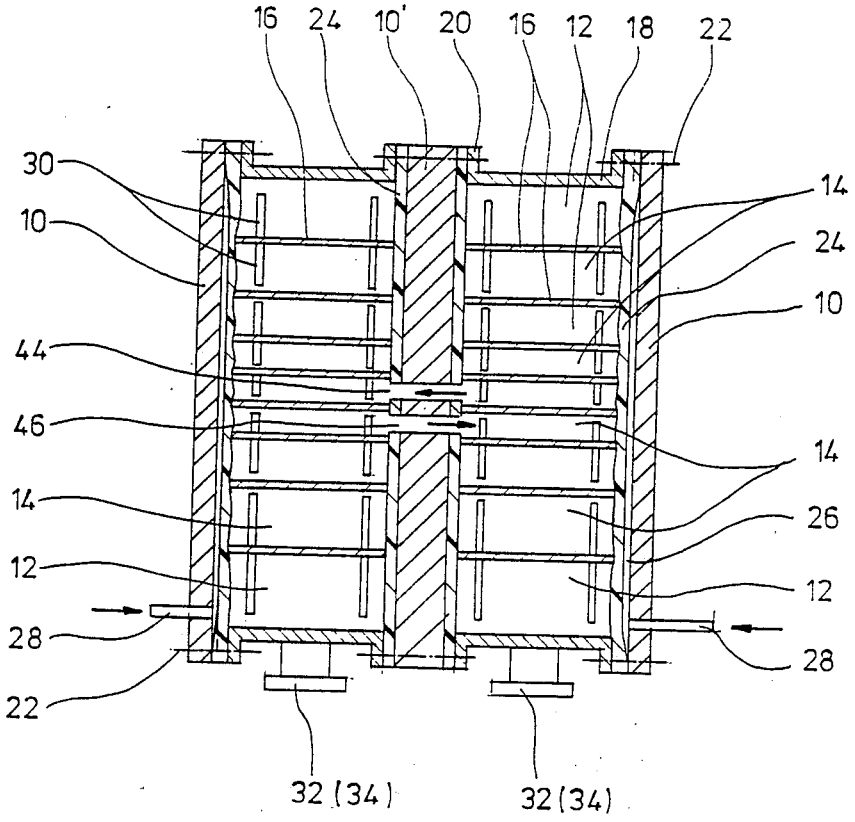
FIG. 1 shows a horizontal section through a twin heat exchanger according to this invention

As shown in FIG. 1, the channels of the "twin heat exchanger" are covered at both front sides by each a plate 10 and in the center by an intermediate plate 10'. The plates, for example, are made of steel. Each of the two heat exchangers of the twin heat exchanger has two into each other running spiral channels 12 and 14, of which the channel 12 provides the flow of a heat yielding medium and the channel 14 the flow of a heat absorbing medium; of course that also could be reversed. The channel walls 16 are composed of an originally plain sheet strip, for example made of steel sheet, which up to the central range is bent spirally to the inside; subsequently the same sheet strip spirally is bent to the outside (compare FIGS. 2 and 3). Thus the two into each other running spiral channels 12 and 14 are resulting from.

The heat exchanger is closed at the surface shell by a cylindrical sleeve 18, from which at both ends radially to the outside each a flange 20 is projecting and which is fastened to the plate 10 resp. to the intermediate plate 10' by means of not illustrated screws.

For sealing the channels 12 and 14 a sealing disk 24 made of elastically flexible material, rubber or plastic for example, is provided at the interior sides of each plate 10 resp. 10', The axial ends of the channel walls 16 are pressed against these sealing disks. The screws 22 produce here a clamp fitting between the channel walls 16 and the plates 10 and 10', so that the axial ends of the channel walls 16 are pressed into these sealing disks 24, as this is shown particularly in FIG. 1.

At the example of FIG. 1, the sealing disk 24 of the intermediate plate 10' all over its surface is jointly connected with the same, while between the opposite saeling disk 24 and the exterior plate 10 there is an interspace 26, into which via a connection tube 28 a pressure medium (liquid or gas) can be introduced. This pressure medium improves the sealing of the channels 12 and 14 to each other and to the outside and it compensates deformations of plate 10 which could result from the interior pressure of the heat exchanger.

In order to assure an approximatively constant height of the channels 12 and 14, distance pins 30 in certain distances are fixed to the sheet strips forming the channel walls 16. These pins are illustrated in FIGS. 1 and 2, they flush axially with each other in the spirally bent state of the sheet strip and thus they keep the channel walls 16 to the required distance from each other.

In most application cases this distance amounts to only about 5 mm. Thus in spite of the small outside surface and the small constructive size a big exchange surface is resulting. When the same should be extended. it's better not to extend the exterior diameter of the heat exchanger, but by the width of the sheet strips the axial extent of the heat exchanger.

Figure 2:
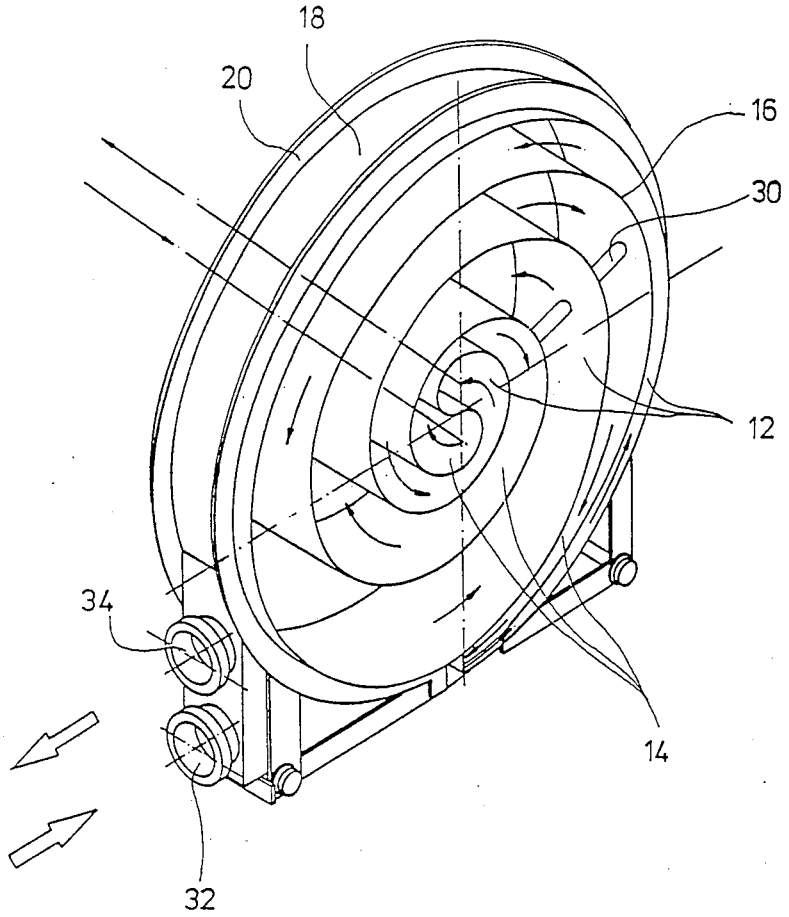
FIG. 2 shows a perspective view of the right half of the heat exchanger with removed plates according to FIG. 1
Figure 3:
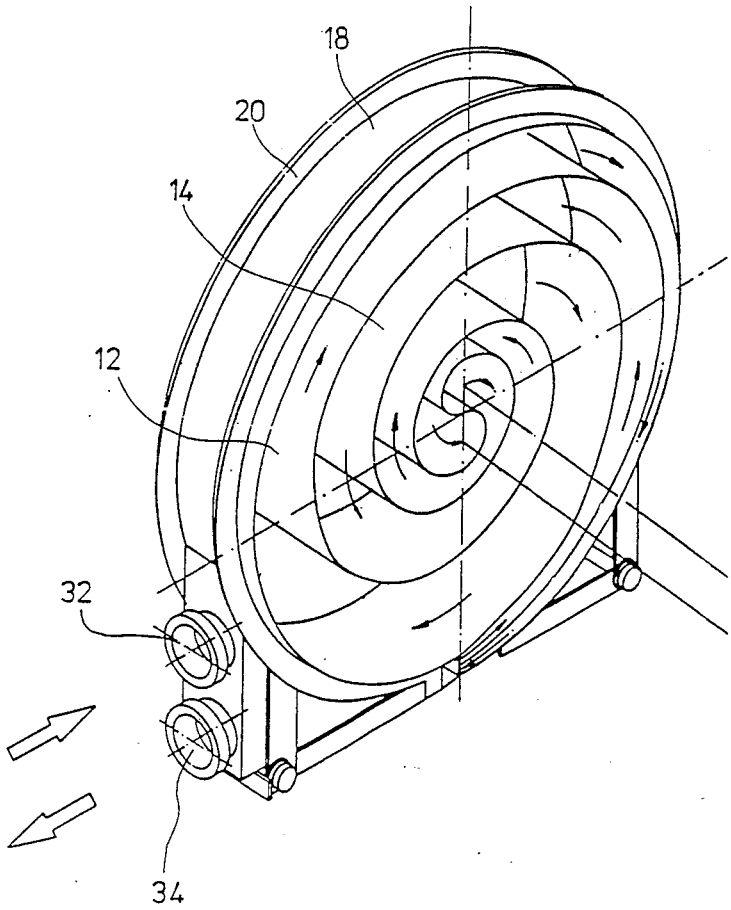
FIG. 3 shows a view corresponding to FIG. 2 of the left part of the heat exchanger shown in FIG. 1

FIGS. 1–3 show that each heat exchanger has an inlet aperture 32 and an outlet aperture 34. These are arranged one over the other and coming from the surface shell of the sleeve 18 they mouth essentially tangential into the corresponding channels 12 resp. 14.

Figure 4:
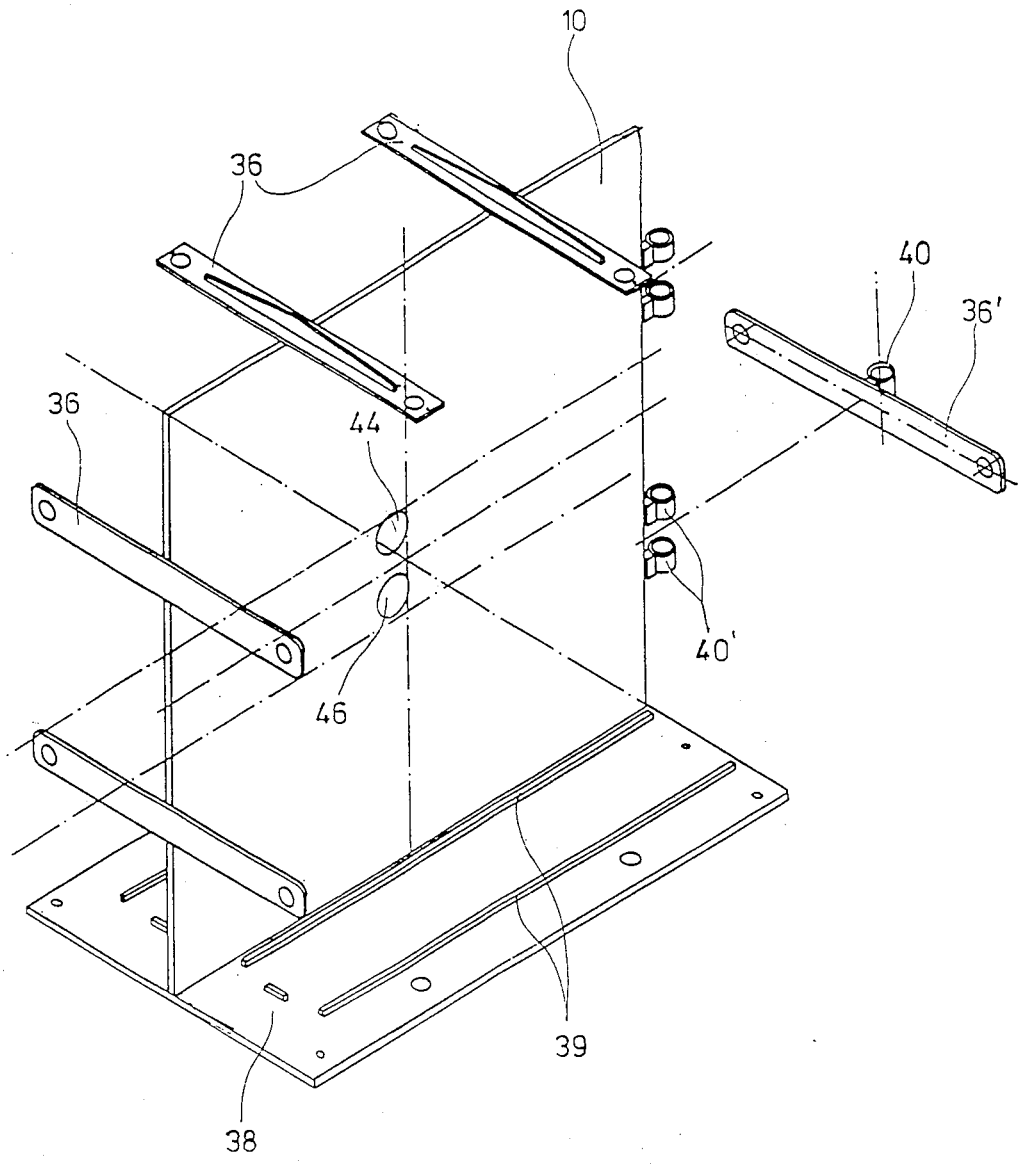
FIG. 4 shows a perspective projection of the intermediate plate separating the two heat exchangers according to the FIGS. 2 and 3 and FIG. 5 shows a perspective view of the provided front side plates.

In FIG. 4 is indicated that for the assembly of the twin heat exchanger it is possible to provide fixing straps 34 at the intermediate plate 10', at the ends of which the two plates 10 can be fastened. The intermediate plate 10' in this case is fixed to a base plate 38, on which parallelly to the base plate 10' two ledges 39 are provided, the distance of which corresponds about to the width of the channel walls 16 and which take up between them the respective heat exchanger with its front side closing plate 10. At one vertical side of the intermediate plate 10 the fixing straps 36' are provided with a fixing eye 40, to which correspond two fixing eyes 40' having been provided at the intermediate plate 10'. The fixing eyes 40, 40' can be connected with each other by means of screw bolts. This arrangement results in a particularly simple dismantling possibility of the heat exchanger, the cleaning of it herewith is very simplified.

Figure 5:
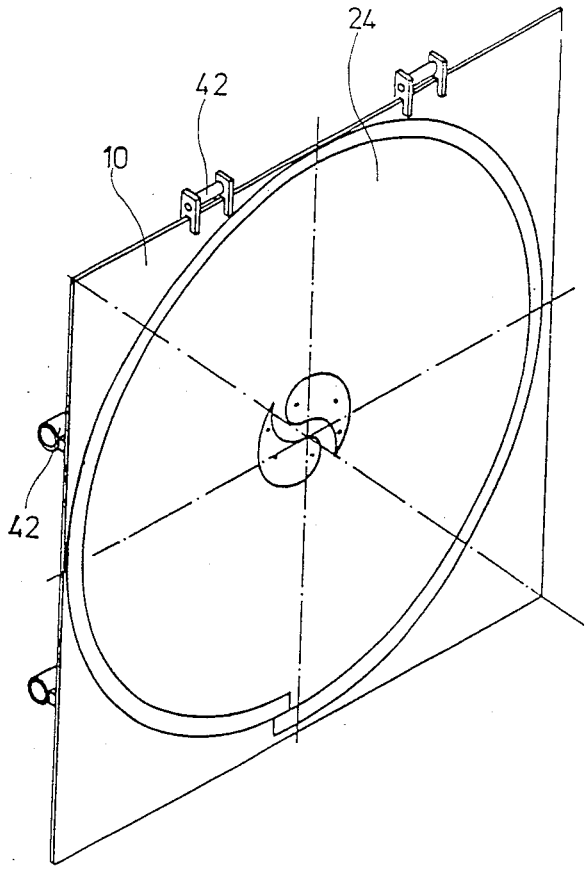

FIG. 5 shows one of the frontally provided plates 10, at which fixing eyelets 42 or the like are provided which can be joined with the fixing straps 36 provided at the ends of the intermediate plate 10'.

In the case of the here described and illustrated constructional example the medium to be cooled flows for example via the inlet aperture 32 of the right heat exchanger, FIG. 1, into the channel 12 up to the center there, from where it flows through a passage aperture 44 in the intermediate plate 10' into the corresponding channel of the next heat exchanger where it leaves the same via the outlet aperture 34. The cooling medium absorbing the yielded heat counterflows first via the inlet aperture 32, shown in FIG. 3, into the channel 14 of the left heat exchanger, FIG. 1, where in the central range via the passage aperture 46 it flows over to the corresponding channel 14 of the right heat exchanger, FIG. 1, and where it leaves the same via the outlet aperture 34.

What is claimed:

1. A heat exchanger for indirect heat transfer between a heat yielding medium and a heat absorbing medium, comprising:

first spirally-disposed wall surfaces having a straight generatrix and defining first and second channels in close thermal relation and through which a heat yielding medium and a heat absorbing medium are respectively flowable, said first wall surfaces having a pair of oppositely-disposed axial edges lying substantially perpendicularly to the direction of medium flow through said channels and defining the open sides of said first and second channels;

second spirally-disposed wall surfaces having a straight generatrixs and defining third and fourth channels in close thermal relation and through which a heat yielding medium and a heat absorbing medium are respectively flowable, said second wall surfaces having a pair of oppositely-disposed axial edges lying substantially perpendicularly to the direction of medium flow through said third and fourth channels and defining the open sides of said third and fourth channels;

a separation wall between said first and second wall surfaces;

said first and fourth channels and said second and third channels being disposed in fluid communication through said separation wall for serial flow of a medium between said first and fourth channels and between said second and third channels;

a first elastically flexible seal member interposed between one side of said separation wall and said one of said axially-disposed opposite edges of said first wall surfaces;

a second elastically flexible seal member interposed between the second side of said separation wall and said one of said axially-disposed opposite edges of said second wall surfaces;

a first end plate disposed along one of said oppositely-disposed axial edges of said first wall surfaces to close one of said open sides and to define one of two axial boundaries of said first and second channels;

a third additional elastically flexible seal member interposed between said first end plate and said one of the axially-disposed opposite edges of said first wall surfaces;

a second end plate disposed along one of said oppositely-disposed axial edges of said second wall surfaces to close one of said open sides and to define one of two axial boundaries of said third and fourth channels;

a fourth additional elastically flexible seal member interposed between said second end plate and said one of the axially-disposed opposite edges of said second wall surfaces, each of said second and fourth additional elastically flexible seal members being positioned for conforming abutment with the respective axial edges of said first and end plates to provide enhanced protection against leakage of medium beyond the respective axial boundary of said channels;

said first and second wall surfaces being each formed of a single unitary bent steel strip; and clamp fitting means for releasably clamping together said first and second end plates, said separation wall and said first and second wall surfaces.

* * * * *